US007817011B2

(12) United States Patent
Araki

(10) Patent No.: US 7,817,011 B2
(45) Date of Patent: Oct. 19, 2010

(54) CHIP TYPE VARIABLE ELECTRONIC PART AND CHIP TYPE VARIABLE RESISTOR

(75) Inventor: Akiko Araki, Ibaraki (JP)

(73) Assignee: Rohm Co. Ltd., Kyoto (JP)

( * ) Notice: Subject to any disclaimer, the term of this patent is extended or adjusted under 35 U.S.C. 154(b) by 895 days.

(21) Appl. No.: 11/597,042

(22) PCT Filed: Apr. 13, 2005

(86) PCT No.: PCT/JP2005/007154

§ 371 (c)(1),
(2), (4) Date: Nov. 17, 2006

(87) PCT Pub. No.: WO2005/122191

PCT Pub. Date: Dec. 22, 2005

(65) Prior Publication Data

US 2008/0164971 A1 Jul. 10, 2008

(30) Foreign Application Priority Data

May 20, 2004 (JP) ..... 2004-150872

(51) Int. Cl.
*H01C 10/32* (2006.01)

(52) U.S. Cl. ..... 338/162

(58) Field of Classification Search ..... 338/162
See application file for complete search history.

(56) References Cited

FOREIGN PATENT DOCUMENTS

| | | | |
|---|---|---|---|
| JP | 3-101502 | | 10/1991 |
| JP | 08191005 | A * | 7/1996 |
| JP | 11-354307 | | 12/1999 |
| JP | 2000353607 | A * | 12/2000 |

OTHER PUBLICATIONS

U.S. Appl. No. 11/597,025, filed Nov. 2006, Araki.
International Search Report for International Application No. PCT/JP2005/007154 dated Jul. 19, 2005.

* cited by examiner

*Primary Examiner*—Elvin G Enad
*Assistant Examiner*—Joselito Baisa
(74) *Attorney, Agent, or Firm*—Hamre, Schumann, Mueller & Larson, P.C.

(57) ABSTRACT

In a chip type variable electronic part including an insulating substrate, and an adjustment rotor made of a metal plate rotatably mounted on an upper surface of the insulating substrate, in which the rotor is constituted of a first plate formed in a bowl shape to receive a screwdriver that rotates the rotor, and a second plate superposed on an upper surface of the first plate and integrally coupled thereto via a fold-back joint, and the second plate includes a screwdriver engagement hole perforated therein for the screwdriver to be fitted in, the fold-back joint is bent downward from an upper surface of the second plate, thereby preventing deformation of the fold-back joint when the rotor is rotated with the screwdriver.

5 Claims, 3 Drawing Sheets

CHIP TYPE VARIABLE ELECTRONIC PART AND CHIP TYPE VARIABLE RESISTOR

TECHNICAL FIELD

The present invention relates to a chip type variable electronic part and a variable resistor constituted of an insulating substrate in the form of a chip, with a rotor for controlling the resistance value or capacitance that is rotatably mounted on the upper surface of the substrate.

BACKGROUND ART

The chip type variable resistor which represents the variable electronic parts includes, as described in patent document 1 and as conventionally well known, an insulating substrate formed in a chip type with a through hole provided at a central portion of the substrate, a resistance film provided on an upper surface thereof in an arcuate shape concentric with the through hole, an external terminal electrode corresponding to the respective end portions of the arcuate resistance film provided on the insulating substrate, and an internal terminal electrode plate made of a metal plate adhered to a lower surface of the insulating substrate and including an integrally formed shaft portion that fits in the through hole. On the upper surface side of the insulating substrate, an adjustment rotor made of a metal plate is rotatably mounted on an upper end portion of the shaft portion, and the rotor is constituted of a first plate formed in a bowl shape to receive a screwdriver that rotates the rotor, and a second plate superposed on an upper surface of the first plate and integrally coupled thereto via a fold-back joint. The first plate is provided with a sliding piece disposed in contact with the resistance film, and a screwdriver engagement hole in which the screwdriver is to be fitted is perforated in the second plate.

Also, in the conventional chip type variable resistor, as described in the patented document 1, an internal terminal electrode plate disposed on the lower surface of the insulating substrate is provided with a stopper piece formed to project upward from the upper surface of the insulating substrate, so that when the rotor rotates the fold-back joint of the rotor is butted to the stopper piece, and a rotation angle of the rotor is thereby delimited.

In the foregoing chip type variable resistor, the adjustment rotor is, as already stated, constituted of the first plate formed in a bowl shape to receive the screwdriver that rotates the rotor, and the second plate superposed on the upper surface of the first plate and integrally coupled thereto via the fold-back joint, in which the first plate is provided with the sliding piece disposed in contact with the resistance film, and the screwdriver engagement hole in which the screwdriver is to be fitted is perforated in the second plate. In other words, rotating the second plate with the screwdriver inserted in the screwdriver engagement hole perforated therein causes the first plate provided with the sliding piece disposed in contact with the resistance film to rotate, with the sliding piece provided thereto maintained in contact with the resistance film, and hence the fold-back joint between the first plate and the second plate is of a laid down U-shape, and the rotation is transmitted from the second plate to the first plate via such fold-back joint, which leads to a problem that when rotating the rotor with the screwdriver, the fold-back joint of the rotor is deformed such that the first plate and the second plate are shifted from each other.

For this reason, the patented document 1 proposes increasing a widthwise dimension of the fold-back joint for preventing the deformation, however increasing the width of the fold-back joint not only makes the folding work of the fold-back joint more difficult but also incurs an increase in weight, and besides when delimiting the rotation angle of the rotor by blocking the fold-back joint with the stopper piece, the rotation angle range is reduced to the same extent as the increase in width of the fold-back joint.

Also, for delimiting the rotation angle of the rotor the fold-back joint is butted to the stopper piece, and hence the stopper piece has to have a sufficient projecting height from the upper surface of the insulating substrate to reach the fold-back joint, which incurs a problem that a strength of the stopper piece is reduced against tilting in a rotation direction of the rotor thus being deformed, caused by the rotation thereof.

To increase the strength of the stopper piece against tilting, a widthwise dimension thereof may be increased in a rotation direction of the rotor, however increasing the width of the stopper piece not only incurs an increase in weight, but also results in reduction in rotation angle of the rotor, to the same extent as the increase in width of the stopper piece.

Patent document 1: JP-A-H11-354307

DISCLOSURE OF THE INVENTION

Problem to be Solved by the Invention

A technical object of the present invention is to provide a chip type variable electronic part and a variable resistor in which the foregoing problems are minimized.

Means for Solving the Problem

To achieve the technical object, a first aspect of the present invention provides a chip type variable electronic part including an insulating substrate and an adjustment rotor made of a metal plate rotatably mounted on an upper surface of the insulating substrate; in which the rotor is constituted of a first plate formed in a bowl shape to receive a screwdriver that rotates the rotor, and a second plate superposed on an upper surface of the first plate and integrally coupled thereto via a fold-back joint, and the second plate includes a screwdriver engagement hole perforated therein for the screwdriver to be fitted in; wherein the fold-back joint is bent downward from an upper surface of the second plate.

A second aspect of the present invention provides the chip type variable electronic part according to the first, wherein the downwardly bent portion of the fold-back joint is formed to be butted to a stopper piece projecting upward from an upper surface of the insulating substrate.

A third aspect of the present invention provides the chip type variable electronic part according to the second aspect, wherein the stopper piece is an upwardly bent portion of an internal terminal electrode plate disposed on a lower surface of the insulating substrate.

A fourth aspect of the present invention provides the chip type variable electronic part according to the third aspect, wherein the stopper piece includes an abutment portion integrally formed therewith, to be in contact with the upper surface of the insulating substrate.

A fifth aspect of the present invention provides the chip type variable electronic part according to any of the first to the fourth aspects, further comprising a resistance film of an arcuate shape concentric with a through hole provided on the insulating substrate; an external terminal electrode corresponding to the respective end portions of the resistance film;

and a sliding piece the adjustment rotor includes disposed in sliding contact with the resistance film.

ADVANTAGES OF THE INVENTION

Since the fold-back joint is, as described in the first aspect, bent downward from an upper surface of the second plate, the fold-back joint turns to be of an upright U-shape instead of the laid down U-shape, and the rotation is transmitted from the second plate to the first plate under the upright U-shaped configuration. In this case the transmission efficiency of the rotational force is improved in comparison with the case where the fold-back joint is of a laid down U-shape, and consequently the fold-back joint can be reliably prevented from being deformed to shift the positional relationship between the first plate and the second plate, without increasing the width of the fold-back joint as in the conventional variable electronic parts.

Also, as described in the second aspect, the downwardly bent portion of the fold-back joint is formed to be butted to a stopper piece projecting upward from an upper surface of the insulating substrate, which allows forming the stopper piece in a lower projecting height from the upper surface of the insulating substrate than in the case where the fold-back joint is butted to the stopper piece, thereby effectively increasing the strength of the stopper piece against tilting in the rotation direction of the rotor thus being deformed, without an increase in width of the stopper piece, and hence without incurring an increase in weight of the rotor, and reduction in rotation angle thereof.

Further, since the stopper piece is an upwardly bent portion of an internal terminal electrode plate disposed on a lower surface of the insulating substrate as described in the third aspect, the formation of the stopper piece can be easily carried out utilizing the internal terminal electrode plate.

In this case, since the stopper piece includes an abutment portion integrally formed therewith, to be in contact with the upper surface of the insulating substrate as described in the fourth aspect, the insulating substrate is held by the stopper piece from an upper and a lower direction, which leads to a further increase in strength of the stopper against tilting in the rotation direction of the rotor, and to reinforced adhesion of the internal terminal electrode plate to the insulating substrate.

Especially, the configuration according to the fifth aspect is advantageous in effectively achieving the foregoing effects in the chip type variable resistor.

REFERENCE NUMERALS

Figure 1:
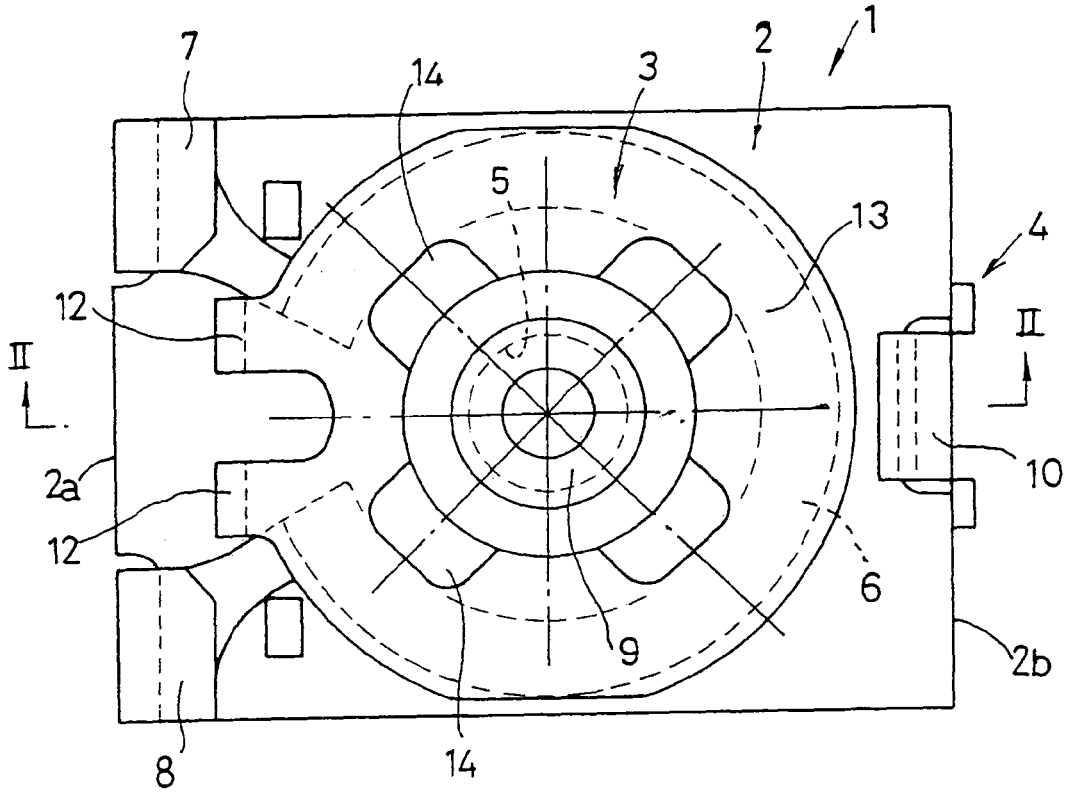
FIG. 1 is a plan view showing a variable resistor according to an embodiment of the present invention.

1 chip type variable resistor
2 insulating substrate
3 adjustment rotor
4 internal terminal electrode plate
5 through hole
6 resistance film
7, 8 external terminal electrode
9 shaft portion
10 stopper piece
10' abutment piece
11 first plate
12 fold-back joint
13 second plate
14 screwdriver engagement hole
16 sliding piece

BEST MODE FOR CARRYING OUT THE INVENTION

Figure 2:
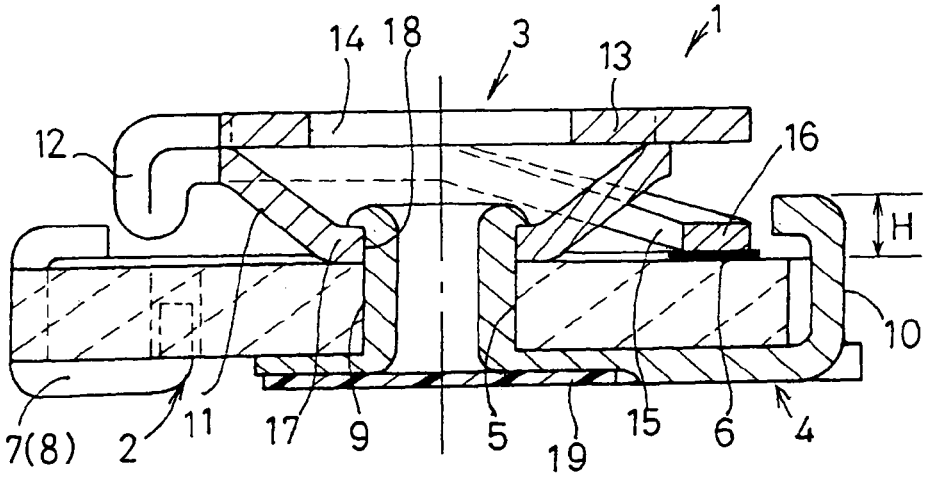
FIG. 2 is a cross-sectional view taken along the line II-II in FIG. 1.
Figure 3:
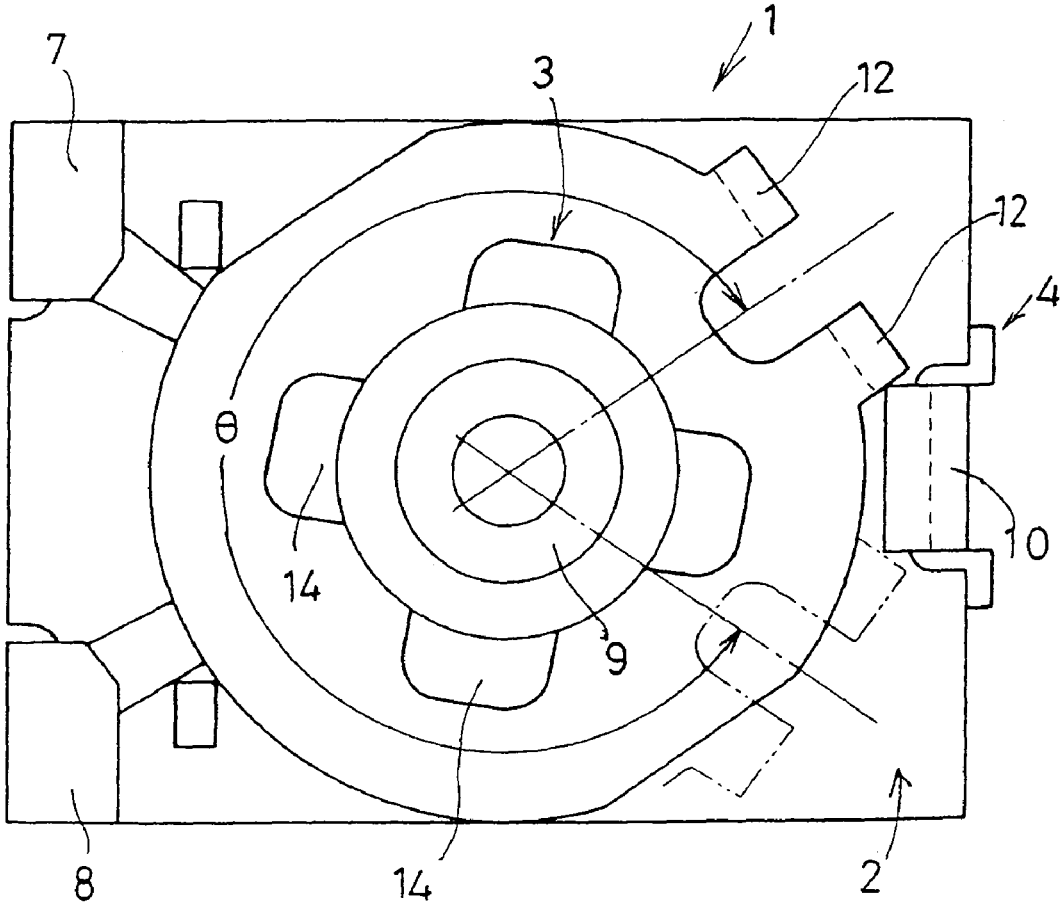
FIG. 3 is a plan view showing a state where the rotor is rotated.
Figure 4:
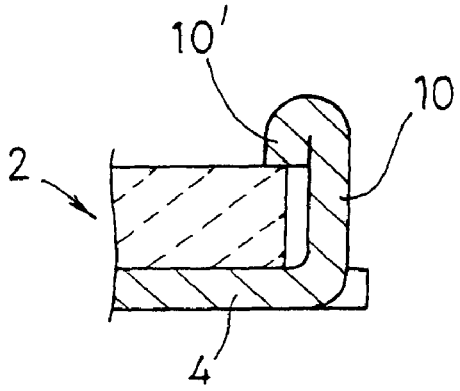
FIG. 4 is a cross-sectional view of a modified stopper.

An embodiment of the present invention will be described below referring to the drawings, in which the present invention is applied to a chip type variable resistor (FIGS. 1 to 3).

In these figures, the reference numeral 1 designates a chip type variable resistor. The chip type variable resistor 1 includes an insulating substrate 2 in the form of a chip made of a heat-resistant insulating material such as a ceramic, an adjustment rotor 3 disposed on the insulating substrate 2, and an internal terminal electrode plate 4 disposed on the lower surface of the insulating substrate 2.

The insulating substrate 2 is formed with a through hole 5 extending from the upper surface to the lower surface of the substrate at a generally central position, and a resistance film 6 disposed to extend thereon in an arcuate shape concentric with the through hole 5, and the insulating substrate 2 is provided, on a lateral face 2*a* thereof, with external terminal electrodes 7, 8 corresponding to the respective end portions of the resistance film 6.

The internal terminal electrode plate 4 is made of a metal plate and disposed in close contact with the lower surface of the insulating substrate 2, and includes a hollow shaft portion 9 integrally formed therewith to be inserted into the through hole 5, and a stopper piece 10 integrally formed therewith to be bent upward along another lateral portion 2*b* of the insulating substrate 2.

The rotor 3 includes a first plate 11 made of a metal plate and formed in a bowl shape with a flange around an outer periphery thereof, and a plate-shaped second plate 13 integrally connected to the first plate 11 via a fold-back joint 12, and the second plate 13 includes a cross-shaped screwdriver engagement hole 14 perforated therethrough, and is bent to be folded back at the fold-back joint 12 thus to be superposed on the upper surface of the first plate 11, while the flange on the outer periphery of the first plate 11 includes a slit hole 15 perforated in a generally semicircular arc in a region opposite to the fold-back joint 12, and a portion of the flange radially outer from the slit hole 15 constitutes a sliding piece 16 to be brought into elastic contact with the resistance film 6.

The rotor 3 is mounted on the upper surface of the insulating substrate 2, such that a mounting hole 18 perforated in a bottom plate 17 of the first plate 11 of the rotor 3 is fitted over the hollow shaft portion 9, and then the lower surface of the bottom plate 17 is closely pressed against the upper surface of the insulating substrate 2 and the sliding piece 16 is set in elastic contact with the resistance film 6, after which an upper end portion of the shaft portion 9 is crimped to extend outward, so that the rotor 3 is attached to the shaft portion 9 to freely rotate around the shaft portion 9.

Then the fold-back joint 12 is bent downward, so that the downwardly bent portion is butted to the stopper piece 10.

Under such structure, the rotor 3 is rotated in left and right directions with a screwdriver inserted into the screwdriver engagement hole 14 of the second plate 13.

The rotational force of the screwdriver is first applied to the second plate 13, and then transmitted to the first plate 11 via the fold-back joint 12 connecting therebetween.

In this case, bending the fold-back joint 12 downward from the upper surface of the second plate 13 erects the fold-back joint 12 to an upright U-shape instead of the laid down U-shape, so that the rotation is transmitted from the second plate 13 to the first plate 11 under the upright U-shaped configuration. Thus, the transmission efficiency of the rotational force is improved in comparison with the case where the fold-back joint is of a laid down U-shape, and consequently the fold-back joint 12 can be reliably prevented from being deformed to shift the positional relationship between the first plate 11 and the second plate 13.

Also, when the rotor 3 is rotated to left and right, the downwardly bent portion of the fold-back joint 12 of the rotor 3 is butted to the stopper piece 10 as shown in FIG. 3, thereby delimiting the rotation range of the rotor 3 within an angle of θ.

In this case, since the fold-back joint 12 is bent downward and such downwardly bent portion is naturally located closer to the upper surface of the insulating substrate 2, which allows forming the stopper piece 10, to which the downwardly bent portion is butted, in a lower projecting height H from the upper surface of the insulating substrate 2 than in the case where the fold-back joint 12 is not bent downward, thereby effectively increasing the strength of the stopper piece 10 against tilting in the rotation direction of the rotor 3 thus being deformed, without an increase in width of the stopper piece 10.

Besides, a portion of the internal terminal electrode plate 4 corresponding to the shaft portion 9 is made thinner, and a film 20 that covers the inside of the shaft portion 9 is adhered to the lower surface of the thinner portion, to prevent intrusion of a flux produced by a soldering process into an inner portion of the rotor 3, when implementing the resistor on a PCB or the like by soldering.

Figure 6:
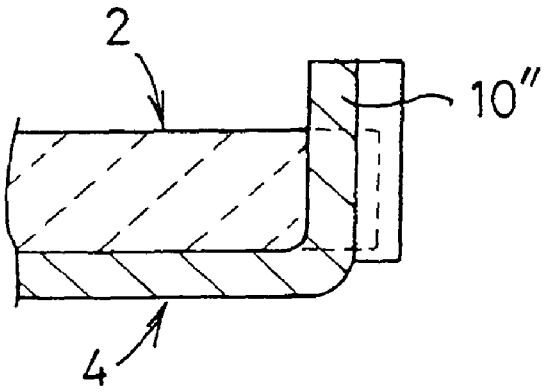
FIG. 6 is a cross-sectional view taken along the line VI-VI in FIG. 5.

Further as shown in FIG. 6, the stopper piece 10 may include an abutment portion 10', integrally formed therewith to make contact with the upper surface of the insulating substrate 2.

With such structure, the stopper piece 10 holds the insulating substrate 2 from an upper and a lower direction with the abutment portion 10' and the internal terminal electrode plate 4, both integrally formed with the stopper piece 10, which significantly increases the strength of the stopper piece 10 against tilting in the rotation direction of the rotor 3. Besides, the internal terminal electrode plate 4 is attached to the insulating substrate 2 at two points, namely the portion of the shaft portion 9 integrally formed with the internal terminal electrode plate 4 crimped over the rotor 3, and the abutment portion 10' integrally formed with the stopper piece 10 holding the insulating substrate 2, which increases the adhesion strength of the internal terminal electrode plate 4 against the insulating substrate 2.

Figure 5:
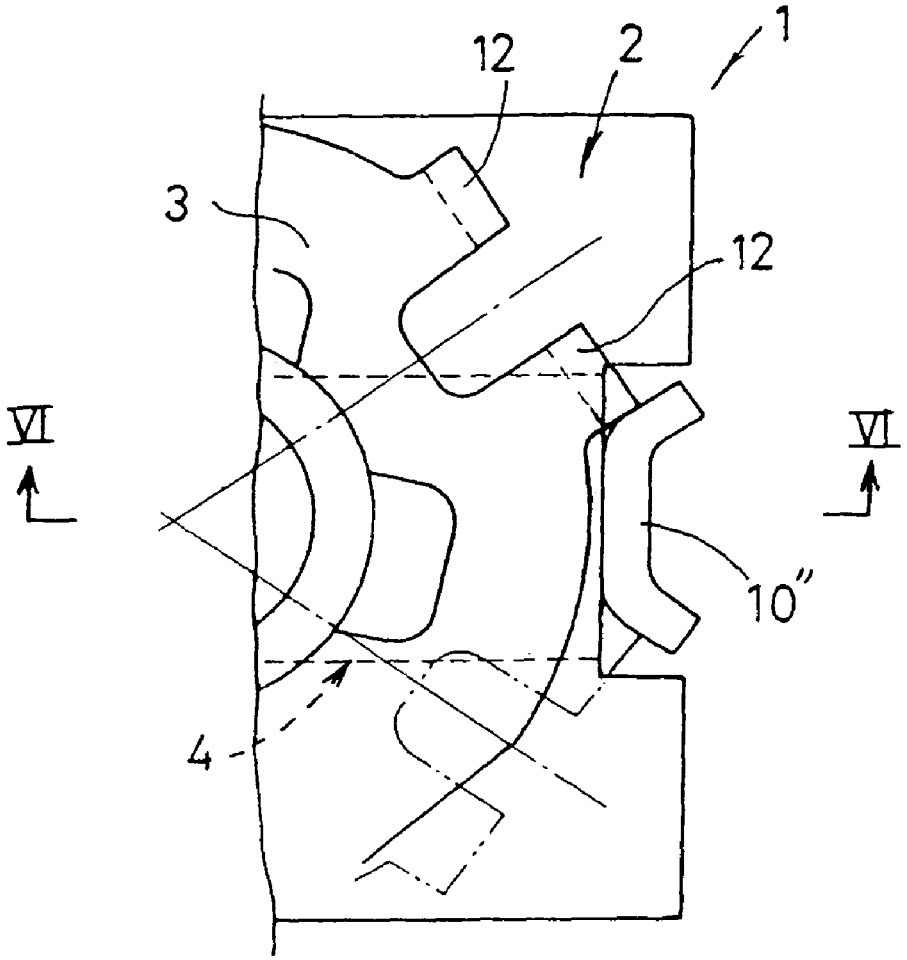
FIG. 5 is a cross-sectional view of another modified stopper.

Still further, the stopper piece may be formed in a shape having a C-shaped cross-section, as a stopper piece 10" shown in FIGS. 5 and 6.

The invention claimed is:

1. A chip type variable electronic part including an insulating substrate and an adjustment rotor made of a metal plate rotatably mounted on an upper surface of the insulating substrate, the rotor including: a first plate formed in a bowl shape to receive a screwdriver for rotating the rotor; a second plate superposed on an upper surface of the first plate; and a fold-back joint for integrally coupling the first plate and the second plate to each other; the second plate being formed with a screwdriver engagement hole into which the screwdriver is fitted, wherein the fold-back joint includes a first portion and a second portion, the first portion extending from the first plate, the second portion extending from the second plate and being superposed on the first portion, both the first portion and the second portion being bent downward from an upper surface of the second plate.

2. The chip type variable electronic part according to claim 1, wherein downwardly bent parts of the first portion and the second portion are formed to be butted to a stopper piece projecting upward from an upper surface of the insulating substrate.

3. The chip type variable electronic part according to claim 2, wherein the stopper piece is an upwardly bent portion of an internal terminal electrode plate disposed on a lower surface of the insulating substrate.

4. The chip type variable electronic part according to claim 3, wherein the stopper piece includes an abutment portion integrally formed therewith, to be in contact with the upper surface of the insulating substrate.

5. The chip type variable electronic part according to any one of claims 1 to 4, further comprising a resistance film of an arcuate shape concentric with a through hole formed in the substrate, and an external terminal electrode corresponding to end portions of the resistance film, wherein the adjustment rotor includes a sliding piece held in sliding contact with the resistance film.

* * * * *